United States Patent [19]

Postbeschild

[11] Patent Number: 4,497,999

[45] Date of Patent: Feb. 5, 1985

[54] WARM-AIR HAND DRYING APPARATUS USING AN INDUCED HEATED AIR FLOW

[75] Inventor: John W. Postbeschild, Witney, England

[73] Assignee: Smiths Industries Public Limited Company, London, England

[21] Appl. No.: 467,049

[22] Filed: Feb. 16, 1983

[30] Foreign Application Priority Data

Mar. 2, 1982 [GB] United Kingdom ..... 8206095

[51] Int. Cl.[3] ..... F24H 7/04; H05B 1/00

[52] U.S. Cl. ..... 219/365; 34/17; 34/84; 219/366; 219/373; 219/378; 417/197

[58] Field of Search ..... 219/365, 368, 367, 366, 219/373, 374, 378; 34/15, 17, 22, 83, 84, 98; 165/123; 417/171, 187, 189, 194, 197

[56] References Cited

U.S. PATENT DOCUMENTS

| | | | |
|---|---|---|---|
| Re. 23,674 | 6/1953 | Spierer | 219/371 |
| 1,224,306 | 5/1917 | Lemp | 219/371 |
| 1,288,507 | 12/1918 | Carmeau | 219/364 |
| 1,419,707 | 6/1922 | Watrous | 219/364 |
| 1,466,093 | 8/1923 | Erb | 219/373 |
| 1,596,837 | 8/1926 | Hopkins | 219/366 |
| 3,664,768 | 5/1972 | Mays et al. | 417/197 |
| 3,802,218 | 4/1974 | Yoshiro | 165/123 |
| 3,823,870 | 7/1974 | Chandler | 98/38 E |
| 3,981,326 | 9/1976 | Gorcher | 417/189 |
| 4,195,780 | 4/1980 | Inglis | 417/187 |
| 4,245,665 | 1/1981 | Anderson et al. | 137/341 |
| 4,257,556 | 3/1981 | Skala | 219/378 |

FOREIGN PATENT DOCUMENTS

| | | | |
|---|---|---|---|
| 1154341 | 6/1956 | France | 98/38 E |
| 2303249 | 10/1976 | France | 219/378 |
| 1436697 | 5/1976 | United Kingdom | 165/123 |

*Primary Examiner*—Roy N. Envall, Jr.
*Assistant Examiner*—G. S. Evans
*Attorney, Agent, or Firm*—Pollock, Vande Sande and Priddy

[57] ABSTRACT

A regulated compressed air source supplies compressed air to a plurality of individual hand dryer stations where an air moving device such as an ejector or venturi operable heat exchanger to a user. In the preferred embodiment, the heat exchanger of each station uses hot water circulated by a pump from a common reservoir to warm the air.

8 Claims, 4 Drawing Figures

WARM-AIR HAND DRYING APPARATUS USING AN INDUCED HEATED AIR FLOW

Figure 1:
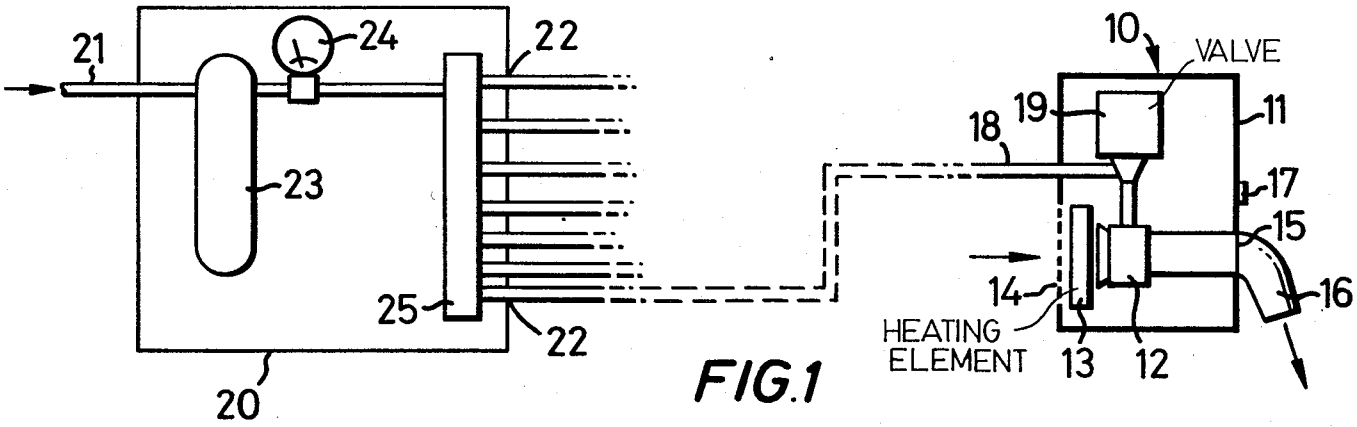

This invention relates to warm-air drying apparatus and, in particular, to warm-air drying apparatus for drying hands or other parts of the body, of the kind comprising means for producing a flow of air, heating means for heating the air forming said flow of air, and an air outlet through which the flow of heated air is discharged onto the hands of a user. The invention also relates to installations including such drying apparatus.

According to a first aspect of the present invention, such warm-air hand drying apparatus is characterized in that said means for producing the flow of air comprises an air moving device operable by compressed gas, and in that control means are provided operable by a user, to control the supply of compressed gas to the air moving device.

Preferably the compressed gas comprises compressed air.

The air moving device may comprise an ejector, venturi, jet pump, air mover, or a fluid flow amplifier.

The heating means may comprise an electrical heating element, or a heat exchanger, through which, for example, hot water is circulated and is preferably disposed upstream from the air moving device.

The compressed gas control means may comprise a manually-operable device connected to a valve arranged to control the supply of compressed gas to the air moving device. The valve may be an electrically energizable solenoid valve, in which case the manually-operable device preferably comprises an electrical switch or proximity sensor. The manually-operable device, or at least a user-operable element thereof, may conveniently be located adjacent the air flow outlet of the apparatus.

The apparatus may further include a housing which contains the air moving device and heating means and through which the outlet for the flow of warm air produced by the air moving device and heating means extends. This outlet may take the form of a nozzle mounted on the housing and may be movably adjustable with respect to the housing whereby the flow of warm air discharged therethrough may be directed onto the hands or the face of a user.

Alternatively, the air moving device, which is generally of tubular form, may be pivotally and/or swivably mounted so that the outlet on the device itself may provide the movably adjustable outlet of the apparatus.

According to another aspect of the present invention, there is provided a warm-air hand drying installation comprising a plurality of warm-air hand drying apparatus in accordance with the first-mentioned aspect of the present invention, a source of compressed gas for operating the air moving device of the apparatus, and distributing means connected to the source of compressed gas and having a plurality of outlets for compressed gas each of which is connected to a respective one of the plurality of apparatus through a supply line.

In the case where the heating means of the plurality of hand drying apparatus comprise heat exchangers, the heat exchangers are preferably arranged to be supplied with heated fluid from a common reservoir, for example, a hot water boiler.

The distributing means may further include a regulator for regulating the pressure of the compressed gas.

The valve of the control means associated with each of the plurality of apparatus may be disposed adjacent the air moving device of that apparatus, for example within the housing of the apparatus, or alternatively adjacent the outlet of the distributing means associated with the apparatus.

The housings of the plurality of hand drying apparatus may be interconnected so as to form a generally elongated trunking having hand drying stations spaced at intervals along its length. The compressed gas supply lines to the hand dryer apparatus are preferably contained within and run through the interconnected housings.

Figure 4:
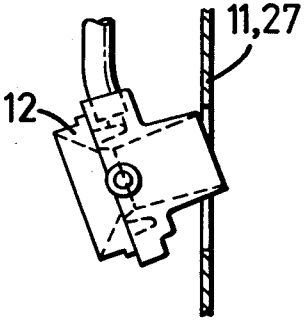
Figure 3:
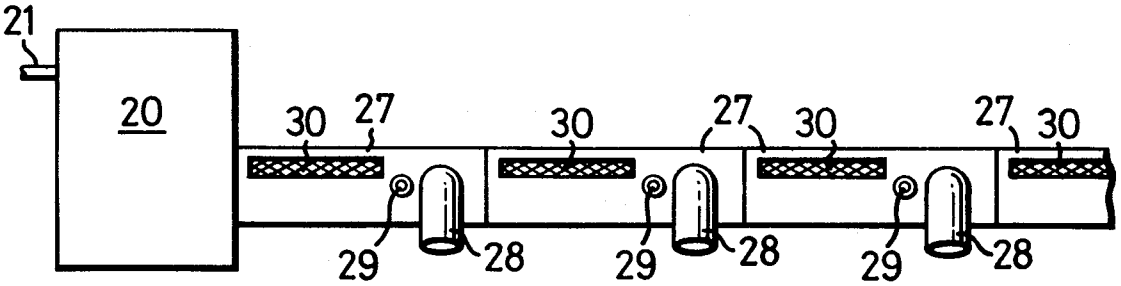
Figure 2:
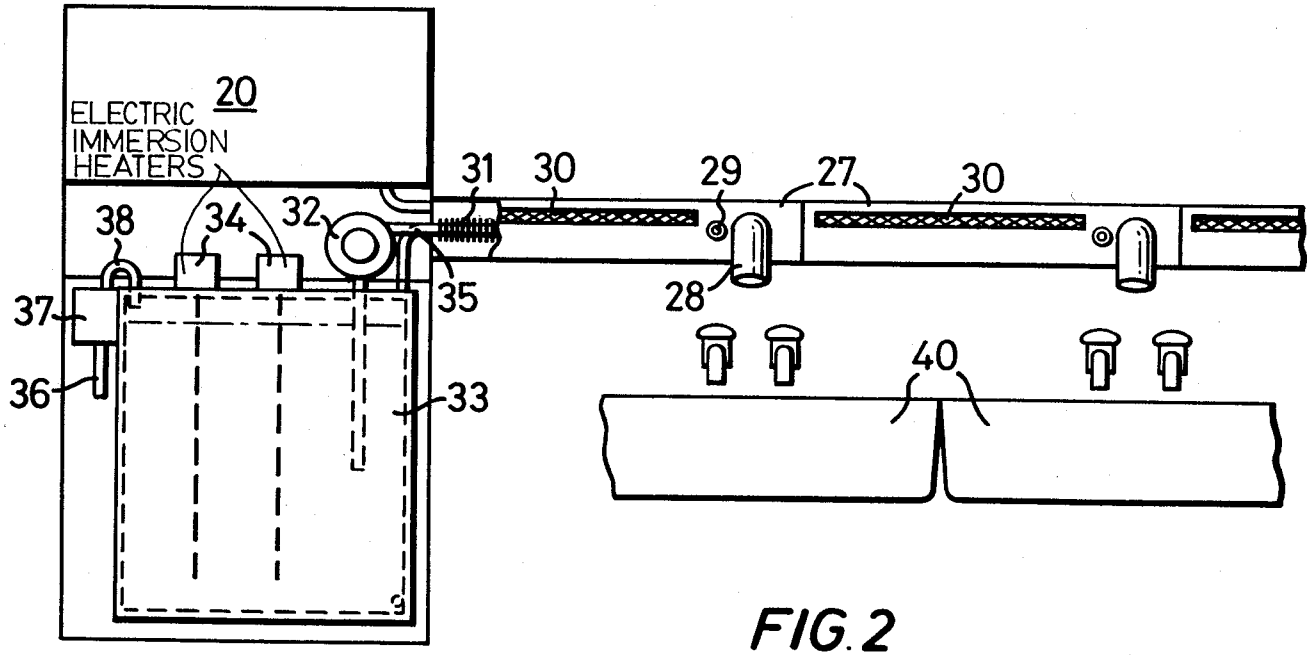

Various warm-air hand drying apparatus and installations in accordance with the present invention will now be described, by way of example, with reference to the accompanying drawings in which:

FIG. 1 shows schematically one embodiment of hand drier apparatus incorporated in an installation particularly suitable for a factory or similar industrial unit, FIG. 2 is a fragmentary view of an installation using indirect heating for the hand drying apparatus, FIG. 3 shows part of one form of factory installation having a plurality of hand drying apparatus, and, FIG. 4 is a fragmentary sectional view of an alternative arrangement for the heated air outlet of the drying apparatus.

Referring to FIG. 1 of the drawing, the installation has warm-air drying apparatus, generally referenced at 10, which includes a housing 11 that contains an air moving device 12 operable by compressed air and heating means 13, for example an electrically-energized heating element.

Air moving devices operable by compressed air are generally well known, and, in their various forms and depending on their particular operating characteristics, they are commonly referred to as venturis, ejectors, jet pumps, air-movers, and fluid flow amplifiers. These devices create large flows of air by inducing ambient air using a small flow of compressed air for their power and are capable of producing output flows up to twenty times as great as their compressed air consumption. Typical examples of such devices are described in, for example, UK Patent Specifications Nos. 1,530,738, 1,303,572, 1,009,170, 1,101,302, 1,137,462, 1,089,937 and 863,124. A typical air mover for example generally comprises a tubular body having a restricted throat region. Compressed air is introduced into the bore of the tubular body through an annular slit having a suitable profile in the wall of the tubular body adjacent this region. The resulting high velocity air flow adheres to the body wall and entrains ambient air to produce a greatly amplified flow of air.

In operation, the air moving device 12 sucks ambient air into the housing 11 through an inlet 14 in the side of the housing. The heating element 13 is disposed preferably between the air moving device 12 and the inlet 14 so that this air is heated by the element 13 prior to entering the air-moving device 12. The flow of warm air produced by the air-moving device 12 is discharged through an outlet 15 in the housing 11 and onto a user's hands to effect drying. The outlet 15 preferably includes a nozzle 16 which serves to direct the flow of warm air generally downwardly and may be swivably mounted in the housing 11 such that it can be turned with respect to the housing so as to direct the discharged flow of warm air upwardly to effect drying of a user's face as well.

The drying apparatus is shown connected in an installation, particularly suitable for use in a factory, since the air moving device 12 is supplied from a compressed air supply which is generally available throughout the factory for powering tools, etc. The compressed air is fed through a supply line 18, via a valve 19 contained in the housing 11 which is connected in series between the supply line 18 and the air moving device 12 and is actuable by a user to control the supply of compressed air to, and therefore operation of, the air-moving device 12. The valve 19 may be an electrically energizable solenoid valve which in its unenergized condition prevents compressed air passing from the line 18 to the device 12 and which is energizable by a user, through for example a manually-operable electric switch 17 located adjacent the outlet 15, or alternatively disposed elsewhere in the housing 11 and coupled mechanically or pneumatically to a user-operable element adjacent the outlet 15, or by means of a proximity sensor mounted on the housing, to allow compressed air to pass to the device 12. Energization of the heating element 13 is also controlled by operation of the manually-operable electric switch or proximity sensor as the case may be. A timing device (not shown) is included so that the solenoid valve 19 and the heating element 13 are energized for a predetermined duration following actuation of the switch or proximity sensor after which they are both, de-energized.

Alternatively, the valve controlling the supply of compressed air may instead be a mechanical valve connected through a suitable linkage to a user-operable element mounted on the housing adjacent the air outlet.

The compressed air source, which would normally be within the pressure range 60 to 150 psig, is fed via a line 21 through a pressure regulating and distributing unit 20 to provide clean, compressed air at a preferred pressure e.g. of the order of 25 psig, for optimum performance of the air-moving device. The regulated pressure, which is monitored by a pressure gauge 24, would, of course, depend upon the number of drying apparatus used in the installation. Thus, as shown in FIG. 1 of the drawings, the air regulating and distributing unit 20, includes an air filter which removes contaminants such as oil and water and a regulator assembly 23 which reduces the pressure of air from the line 21 to the preferred operating pressure for the air moving device 12, and which maintains this pressure irrespective of the number of drying apparatus in use at any one time. The clean and dry regulated compressed air is passed to a distribution manifold 25 containing a plurality of outlets 22, which may each be connected via a respective solenoid valve 19 to a corresponding number of warm air drying apparatus. For simplicity, however, only one such apparatus has been shown in the Figure.

The solenoid valve 19 may be located in the unit 20 between the distribution box 25 and the supply line 18 rather than within the housing 11 as shown in the Figure, and controlled remotely through electrical leads from a manually-operable electric switch or proximity sensor mounted on the housing 11 adjacent the outlet 15.

Furthermore, heating means other than electrical heating means may be employed for heating the flow of air produced by the air moving device 12. For example, referring to FIG. 2, a heat exchanger matrix 31 may be used through which a heated liquid medium is circulated by means of a pump 32 controlled in accordance with operation of the aforementioned manually-operable switch or proximity sensor. The liquid medium may be hot water derived from, for example, a washroom's hot water supply system. However, the manner in which this hot water is circulated and also the temperature level at which it is set may make this impracticable in many situations. Therefore, particularly in the case of an installation having a plurality of hand drying stations, hot water is preferably supplied from an independent gas or oil fired water boiler or a thermally-insulated hot water tank 33 (as shown) having electric immersion heaters 34, said hot water being fed through respective pipes 35 to the heat exchange matrix 31 at each of the hand drying stations. Thus, the heated water is stored in a tank located remote from the heat exchangers, possibly adjacent the regulating and distributing unit 20, as shown, and maintained at a desired temperature level (e.g. of the order of 200° F.) by thermostatic control of the immersion heaters. To maintain water equilibrium in the tank 33, the main water supply 36 may be fed via a top-up tank 37 and expansion pipe 38 to the tank 33. With all the hand drying stations in their inoperative condition, the arrangement permits hot water from the storage tank to circulate through the heat exchanger matrices under thermosiphon action so that there tends to be a build up of static heated air around each heat exchanger matrix. Thus, when one of the electric switches 17 associated with a hand dryer station is pressed to actuate the pump and circulate hot water through the respective heat exchanger matrix 31, there will be no delay in available heat, the static heated air around the matrix being immediately available to the user . In an alternative arrangement, it is envisaged that a respective solenoid valve may be disposed in the hot water supply pipe to each heat exchanger and arranged to open in accordance with actuation of the electrical switch of the associated hand dryer station so that hot water is pumped through only the heater exchanger matrices of those hand dryer stations which have been activated.

The air heating means, whether it be an electric heating element or a heat exchanger, can be located downstream of the air moving device 12 rather than upstream as previously described with reference to FIG. 1 provided it is suitably configured so as not to impede unduly the flow of air emanating from the air moving device.

It is also envisaged that other suitable compressed gases may be used to power the air moving device 12 instead of compressed air.

In a multi-station hand dryer installation, the individual hand dryer stations may be contained in separate and independently mounted housings as described above with reference to FIG. 1, or, alternatively, may be contained in housings which are interconnected with one another for example in a serial fashion.

Referring now to FIG. 3, particularly for use in a factory or similar, a multi-station hand dryer installation comprises a plurality of housings 27 defined in an elongated trunking, which is appropriately divided by separating plates, with the regulating and distributing unit 20 attached at one end thereof. Each station of the assembly, defined by a housing 27, includes an air moving device and heating means, an air outlet nozzle 28 through which the heated air flow is discharged and which is rotatable to direct that air flow onto a user's hands or face, and a manually-operable push-button switch 29 (or proximity sensor) for controlling supply of compressed air to the air moving device, and also the heating means if necessary. As described above, a compressed air line extends from the unit 20 to the air moving device at each station through the housing 27, which latter also contain electrical leads for the manually-operable switches 29 and power supply lines for electrical heater elements, or hot water supply pipes for heat exchangers, as the case may be. An air inlet grill 30 is also provided in each housing 27 through which ambient air is drawn to flow over the heating means when the station is in use.

Referring now to FIG. 4, instead of having a separate swivable outlet 16, 28 for the drying apparatus as described above, the air mover 12 at the or each drying station may itself be swivably or rotatably mounted so that the outlet of the air mover itself also performs the function of the drier outlet. This, of course, elminates the need for a separate outlet, and also improves the efficiency of the heated air flow by (i) reducing the length of the air exit path, and (ii) by ensuring that the air exits in a straight path and not via the rounded type of outlet, nozzle (see FIG. 1, reference 16) normally used in hand drying apparatus.

Warm air hand drying apparatus using an air moving device operable by compressed gas in the aforementioned manner offers a significant advantage over previously known types of hand drying apparatus. Heretofore it has been common to employ in hand drying apparatus an electric motor driven fan, usually a centrifugal fan, for creating a flow of air. Such fans are, however, relatively bulky. In comparison, an air moving device is significantly smaller, thereby considerably reducing the apparatus and the space required for their installation. An installation having a number of hand drying apparatus may therefore be conveniently mounted on, for example, an existing wall of a washroom where available space may be at a premium, preferably with a drying station positioned above each wash basin 40 (see FIG. 2). Another advantage is that the use of a compressed gas operated air moving device in the apparatus greatly increases the safety aspect in contrast to known arrangements employing electrical fans.

In FIG. 4, the compressed air feed pipe is shown as a flexible pipe connected through the upper part of the air mover 12. Alternatively, using a suitable rotatable coupling this pipe can be connected along the pivot axis of the air mover. This has the advantage that the pipe will not hinder pivoting movement of the air mover. Also, the feed pipe need not be flexible.

I claim:

1. A warm-air drying installation comprising a plurality of warm-air hand drying apparatuses, a source of compressed gas, and distributing means connected to the source of compressed gas and having a plurality of outlets for compressed gas each of which is connected to a respective one of the plurality of apparatuses through a supply line, each said apparatus comprising an air moving device operable by the compressed gas, said air moving device having an air inlet through which ambient air enters the air moving device and is entrained by the compressed gas, and an air outlet through which the entrained ambient air flows and is discharged into the hands of the user, and each said apparatus including heating means located at the air inlet of said air moving device for heating the ambient air flowing through the air moving device.

2. A warm-air drying installation according to claim 1 wherein each apparatus includes compressed gas control means comprising a manually-operable device connected to a valve arranged to control the supply of compressed gas to the air moving device.

3. A warm-air drying installation according to claim 2, wherein said valve is an electrically energisable solenoid valve, and said manually-operable device comprises an electrical switch.

4. A warm-air drying installation according to claim 1 wherein the air moving device of each apparatus is of generally tubular form and is movably mounted so that the outlet of the air moving device is adjustable to permit the flow of warm air discharged from said device to be selectively directed onto the hands and face of a user.

5. A warm-air drying installation according to claim 1 in which the heating means of the plurality of hand drying apparatuses comprises a plurality of heat exchangers, one for each such apparatus, connected to a common source of heated fluid.

6. A warm-air drying installation according to claim 1 in which said distributing means includes a regulator for regulating the pressure of the compressed gas.

7. A warm-air drying installation according to claim 1 wherein each said apparatus includes a housing, the housings of the plurality of hand drying apparatuses being interconnected so as to form a generally elongated assembly having hand drying stations spaced at intervals along its length.

8. A warm-air drying installation according to claim 7 wherein the compressed gas supply lines to the hand drier apparatuses are contained within and run through said interconnected housings.

* * * * *